United States Patent [19]

Chan

[11] 3,989,167

[45] Nov. 2, 1976

[54] LIQUID-SOLID DISPENSER

[76] Inventor: See Fong Chan, 47-09 Newtown Road, Astoria, N.Y. 11103

[22] Filed: Nov. 26, 1975

[21] Appl. No.: 635,388

[52] U.S. Cl. ..... 222/145; 239/226

[51] Int. Cl.[2] ..... B67D 5/56

[58] Field of Search ..... 222/129.2, 227, 145, 222/241, 240, 57; 239/225, 226, 142, 308, 310, 316

[56] References Cited

UNITED STATES PATENTS

| | | | |
|---|---|---|---|
| 2,580,629 | 1/1952 | Wenzel | 239/226 X |
| 3,134,546 | 5/1964 | Laughlin | 239/226 X |

*Primary Examiner*—Stanley H. Tollberg

[57] ABSTRACT

A solid-liquid dispenser employing components driven by liquid flow which in addition to the flow itself adjacent tube openings in the principal flow line provide a mechanically induced flow into and out of a container for the solid material for effectively producing the desired mixture on the outlet side of the dispenser. The flow activating the mechanical components which produce the improved mixture is located on the outlet side of the device and is intentionally directed upwardly against gravity which, it is believed, in itself is further instrumental in improving the uniformity of the final mixture.

6 Claims, 2 Drawing Figures

LIQUID-SOLID DISPENSER

The invention relates to solid-liquid flow through devices such as garden sprinklers and the like which employ the liquid travelling through the principal flow line to effect a proper mixing and dispensing of the liquid and solid in solution materials.

The present invention contemplates a solid-liquid dispensing system which in general utilizes a gear train to drive pistons, screws and the like to produce the pressure necessary to induce flow of the solid solution into the liquid travelling through the main flow line. The train is itself driven by the force of the mixture flowing in a vertical line on the outlet side of the system. In the embodiments of the invention illustrated herein the device is used as a garden hose and sprinkler, and the flow induced rotational drive for the gear train is provided by a conventional rotating sprinkler.

One object of the invention is to provide an improved liquid solid in solution mixing and dispensing device wherein the desired mixture is produced at least in part by liquid flow activated mechanical components.

Figure 1:
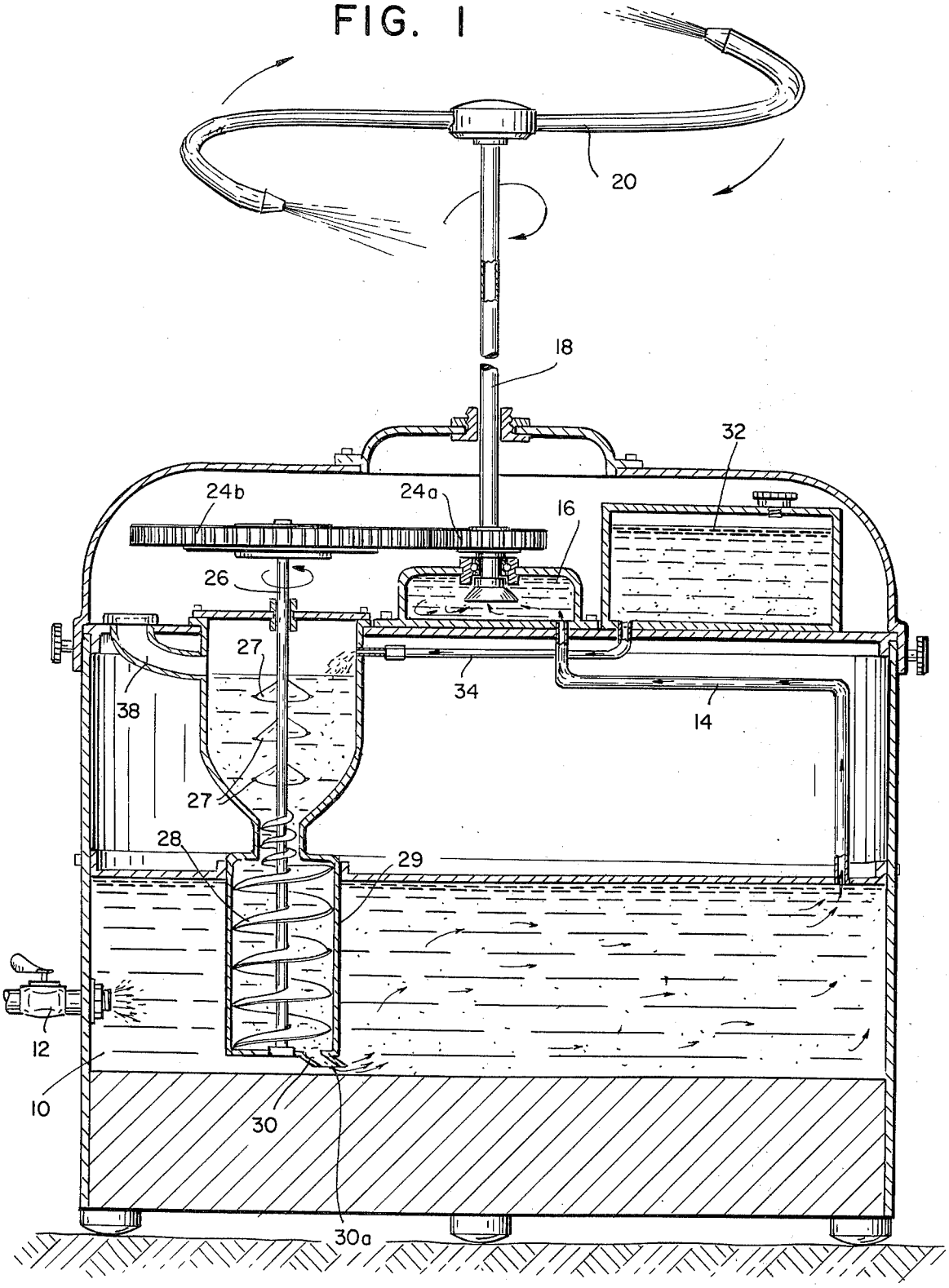
Figure 2:
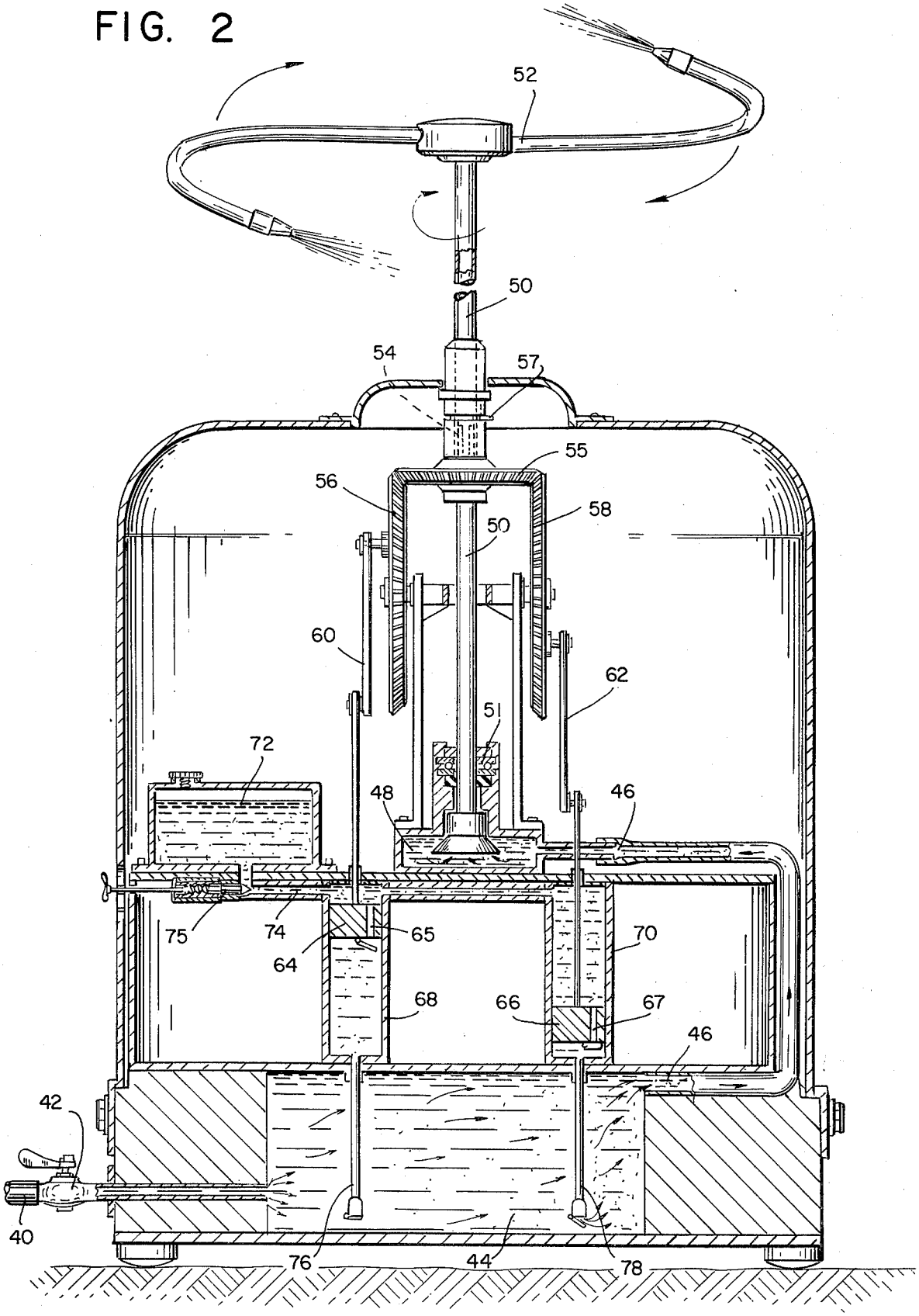

Other objects and advantages of the invention may be appreciated on reading the following description of two embodiments thereof which is taken in conjunction with the accompanying drawings, in which:

FIG. 1 is an elevation view of one embodiment of the improved liquid-solid mixer and dispenser; and FIG. 2 is a section in elevation showing another embodiment of the invention.

Referring to FIG. 1 there is provided a principal liquid valve 12 on its inlet side to adjust the speed of flow through the dispenser. An outlet tube 14 connects the end of the flow line 10 with a chamber 16. Rotatably journalled in the upper wall of the chamber 16 is riser pipe shaft 18 at the top of which a rotating sprinkler 20 is mounted which drives the riser shaft in rotation due to the impact of liquid mixture flow therein. A drive gear **24*a* is afixed to the vertical riser pipe 18 being a component of a gear train, large gear 24*b* being the second component therein. Downwardly directed drive shaft 26 is mounted to the underside of the gear 24*b*. Shaft 26 is the drive component of screw impeller 28 which is housed in solid flow cylinder 29. The ends of the blades of the screw 28 are in light touching and waterproof contact with the inner wall of the cylinder 29. Outlet tube 30 is in communication with the cylinder 29 and extends into the main flow line 10 having an outlet opening 30*a*** close to the wall structure opposite to that through which it extends.

Fertilizer chamber 32 is connected by tubing 34 with the interior of the cylinder 29 whereby in operation of the device the screw impeller 28 in combination with the low pressure end of outlet tube 30 effects the desired flow of the liquid material into the main flow line 10, tube 14 and chamber 16 for eventual passage through the riser pipe 18 into the rotating spinkler to accomplish the irrigation and fertilization intended as the exclusive function of the device. In lieu of liquid mix, solid powder material may be introduced into the cylinder by means of inlet spigot 38.

Referring to FIG. 2, hose 40 having a control valve 42 is placed in communication with mix chamber 44. Outlet passage 46 provides communication between chamber 44 and a second chamber 48 which is itself in communication with rotatable sprinkler shaft 50 journalled in bearing box 51. Liquid flow through the shaft

50 causes sprinkler 52 to rotate in the usual manner. Vertical tooth gear 54 is in normal engagement with a threaded aperture in bevel gear 55 the outer threads of which are in permanent engagement with opposing gears 56 and 58. If desired, the shaft 50 may be axially raised to disengage gears 54 and 55 when the user cuts off the fertilizer. Split ring 57 is inserted on the shaft 50 when the gear 54 on the raised shaft 50 is disengaged from gear 55. The gear 54 is shown in dotted line in its raised or disengaged position. Piston links 60 and 62 are eccentrically connected at one end to the gears 56 and 58, respectively, and at their other end to pistons 64 and 66, respectively.

The heads of pistons 64 and 66 having one way passages 65 and 67 are housed in cylinders 68 and 70, respectively, which are in communication with fertilizer tank 72 by means of passage 74 when valve 75 is opened. The fertilizer solution is introduced into the mix chamber 44 by outlet tubes 76 and 78 connected into the cylinders 68 and 70, the outlet ends of the tubes being closely adjacent the bottom wall thereof. The pressure at the outlet opening of the tubes 76 and 78 and is relatively low which serves to aid the flow of the solution into the main water line and also to enhance the efficiency of the drive mechanism for the sprinkler. It is seen that in operation the fertilizer mixture is caused to flow under the head pressure provided at the valve 42 toward the sprinkler section of the device from which it is ejected for the purpose of producing the desired fertilization of the surrounding land area.

Various modifications of the invention may be effected by persons skilled in the art without departing from the scope and principle thereof as defined in the appended claims.

What is claimed is:

1. A solid-liquid mixing and dispensing device comprising a main flow line, a rotatable flow-through shaft in rotatably driven connection and in communication with said flow line, a solid material container, a conduit in communication with said container and flow line, means driven by said rotatable shaft for causing flow of solid material from the container into said main flow line and a device mounted on said rotatable shaft adapted to be driven in rotation on liquid flow therethrough.

2. A dispenser as defined in claim 1 wherein said means is a cylinder and screw impeller, driven by said shaft, said cylinder being connected into said flow line, and said rotatable shaft is a vertically disposed hollow riser.

3. A dispenser as defined in claim 2 wherein said cylinder has an outlet opening closely adjacent the wall structure of the flow line opposite to that through which the cylinder extends and an opening is provided in said cylinder for the introduction therein of powdered fertilizer.

4. A device as defined in claim 1 wherein said means comprises a gear mounted on said shaft, a piston cylinder in communication with said container and said flow line and a piston having a passage through the head thereof disposed in said chamber, and means for providing a driving connection between said gear and said piston.

5. A device as defined in claim 2 whereby said cylinder is in communication with said flow line by means of a tube the outlet opening of which is closely adjacent a wall for said line opposite to a wall therefor through which said tube extends from the interior of said cylinder whereby the efficiency of said device is enhanced.

6. A device as defined in claim 3 wherein said means comprises a gear mounted on said shaft, a piston chamber in communication with said container and said flow line and a piston having a passage through the head thereof disposed in said chamber, and means for providing a driving connection between said gear and said piston.

* * * * *